US010030410B2

(12) United States Patent
Lin et al.

(10) Patent No.: US 10,030,410 B2
(45) Date of Patent: Jul. 24, 2018

(54) DOOR HANDLE ADAPTER WITH HIDDEN FASTENER

(71) Applicant: Spectrum Brands, Inc., Middleton, WI (US)

(72) Inventors: James Lin, Laguna Niguel, CA (US); Thomas P. Morse, Wyomissing, PA (US)

(73) Assignee: Spectrum Brands, Inc., Middelton, WI (US)

( * ) Notice: Subject to any disclaimer, the term of this patent is extended or adjusted under 35 U.S.C. 154(b) by 0 days.

(21) Appl. No.: 15/602,652

(22) Filed: May 23, 2017

(65) Prior Publication Data

US 2017/0335597 A1 Nov. 23, 2017

Related U.S. Application Data

(60) Provisional application No. 62/340,199, filed on May 23, 2016.

(51) Int. Cl.

| | |
|---|---|
| ***E05B 1/00*** | (2006.01) |
| ***E05B 5/00*** | (2006.01) |
| ***E05B 9/08*** | (2006.01) |
| *E05B 65/08* | (2006.01) |

(52) U.S. Cl.
CPC ..... *E05B 1/0015* (2013.01); *E05B 9/082* (2013.01); *E05B 65/08* (2013.01)

(58) Field of Classification Search
CPC ..... Y10T 16/458; Y10T 16/462; E05B 1/00; E05B 1/0015; E05B 1/0053; E05B 1/003; E05B 1/06; E05B 9/082; B05B 5/00; B05B 5/006; B05B 65/08; B21D 28/10; B21D 53/38; A47B 95/02; A47B 2095/027
See application file for complete search history.

(56) References Cited

U.S. PATENT DOCUMENTS 2,603,821 A * 7/1952 Bacon ..... E05B 1/0015 16/412
2,771,627 A * 11/1956 Hammer ..... A47B 95/02 16/416
2,793,386 A * 5/1957 Muhlhauser ..... A47B 95/02 16/416

(Continued)

FOREIGN PATENT DOCUMENTS

DE 2947251 A1 * 5/1981 ..... A47B 95/02
DE 202013102865 U1 * 7/2013 ..... F16B 9/026

(Continued)

*Primary Examiner* — Chuck Mah
(74) *Attorney, Agent, or Firm* — Merchant & Gould P.C.

(57) ABSTRACT

A door handle may be mounted to a door with concealed fasteners. The fasteners do not engage the door itself, but rather engage a top plate that is mounted to the door. The fasteners are inserted into a hidden portion of the door handle and generate an opposing force as they press against a bulging portion of the top plate to produce a force that retains the door handle in place. The force generated also urges the door handle into a bottom plate on an opposing side of the door handle. The bottom plate includes a first and second planar section. The second planar section of the bottom plate is received into a receiving slot of the door handle. As a result, the door handle is retained on the door without any visible fasteners.

15 Claims, 11 Drawing Sheets

(56) References Cited

U.S. PATENT DOCUMENTS

| | | | | | |
|---|---|---|---|---|---|
| 3,742,554 | A * | 7/1973 | Houtnnan | A47B 95/02 | 16/416 |
| 4,744,126 | A * | 5/1988 | Bisbing | A45C 13/26 | 16/443 |
| 5,074,009 | A * | 12/1991 | Simonton | A47B 95/02 | 16/416 |
| 5,144,718 | A * | 9/1992 | Ozawa | E05B 1/0015 | 16/412 |
| 5,355,554 | A * | 10/1994 | Magoon | E05B 1/0015 | 16/412 |
| 5,553,354 | A * | 9/1996 | Trulaske, Sr. | A47B 95/02 | 16/412 |
| 5,797,164 | A * | 8/1998 | Donaghy | A47B 95/02 | 16/412 |
| 5,927,836 | A * | 7/1999 | Herr | D06F 39/12 | 16/412 |
| 2008/0216284 | A1* | 9/2008 | Ramsauer | E05B 1/0015 | 16/110.1 |
| 2009/0007385 | A1* | 1/2009 | Kim | E05B 1/0015 | 16/412 |
| 2010/0281651 | A1* | 11/2010 | Ramsauer | E05B 1/0015 | 16/110.1 |
| 2016/0237717 | A1* | 8/2016 | Herman | E05B 1/0015 | |
| 2017/0159324 | A1* | 6/2017 | Longest | E05B 1/0015 | |

FOREIGN PATENT DOCUMENTS

| | | | |
|---|---|---|---|
| JP | 10037542 | A * | 2/1998 |
| JP | 2012015021 | A * | 1/2012 |

* cited by examiner

FIG. 6
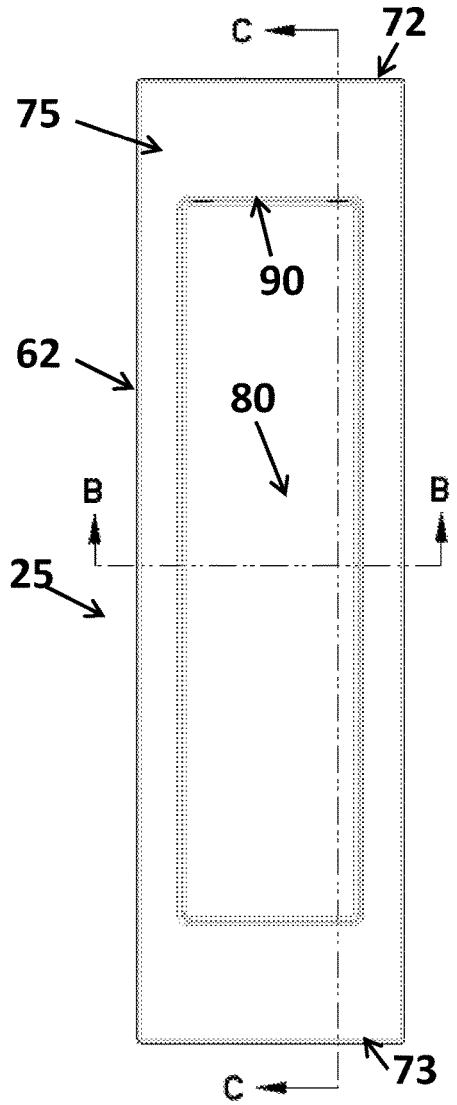
FIG. 7
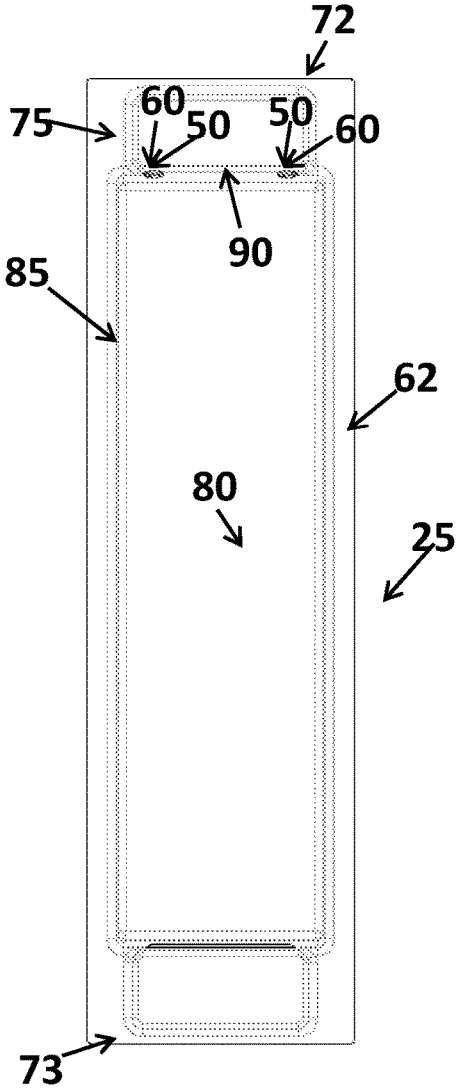
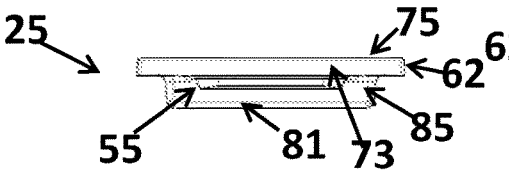
FIG. 8
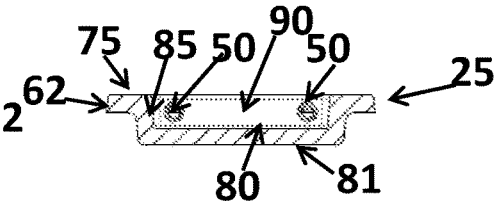
SECTION B-B
FIG. 9

FIG.11
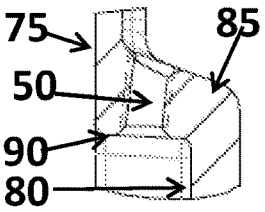
DETAIL A
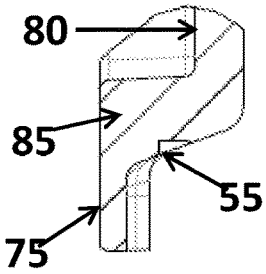
DETAIL D
FIG. 12
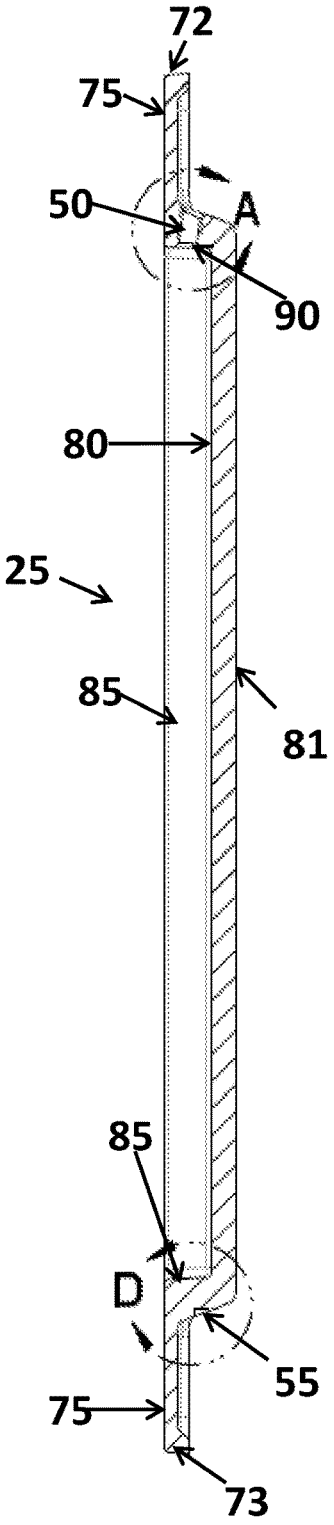
SECTION C-C
FIG. 10

SECTION D-D

FIG. 20
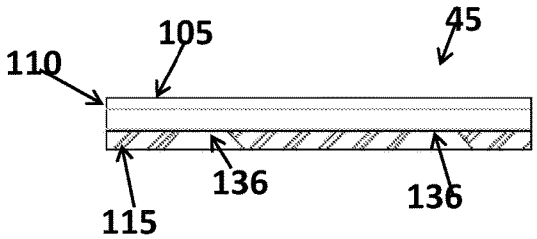
SECTION E-E
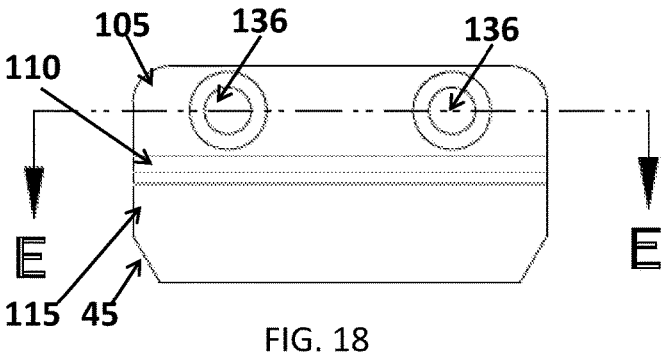
FIG. 18
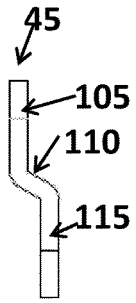
FIG. 19

DOOR HANDLE ADAPTER WITH HIDDEN FASTENER

CROSS REFERENCE TO RELATED APPLICATIONS

This application claims priority to provisional application Ser. No. 62/340,199 titled Door Handle Adapter with Hidden Fastener filed on May 23, 2016, the entire contents of which are hereby incorporated by reference.

FIELD OF THE INVENTION

This invention relates to the field of door handles. More particularly, it relates to adapters for mounting door handles with hidden fasteners.

BACKGROUND OF THE INVENTION

Door handles are known to be fastened to doors to provide users with a convenient way to move the door to and from an open and a closed position. There are many styles of doors and door handles available for installation. Regardless of the type or style of door used, a handle is often attached to the door as both an aesthetic component and a utilitarian feature.

For example, some styles of doors slide along a track as they are opened and closed. Other doors are known to pivot about a hinge. Regardless of the style or operation of the door, the function and look of the handle defines the user's experience. As a result, it is desirable to fasten the door handle to the door in an aesthetically pleasing manner.

Such known door handles accomplish this task by incorporating the door handle fasteners into the design. The fasteners are typically spaced about the perimeter of the handle in a symmetrical manner to balance out the retaining force as well as any physical detraction from the handle itself.

When installed on sliding doors, such as pocket doors, the door handle is typically recessed into the door to avoid interference with the door frame or wall. A pocket, hole, or recess may be cut into the surface of the door that receives the door handle. Recessing the handle into the door allows the door to maintain a low profile, such as in a pocket door. The door may then slide into the pocket without interference between the handle and the door frame or wall. The fasteners are, therefore, typically installed through the portion of the handle on the surface of the door and into the door. In other words, fasteners are driven through the face of the handle and into the surface of the door.

Door handles with visible fasteners have endured great success in the industry. What is needed is an improved door handle fastener system that conceals the fasteners to provide a cleaner and more aesthetic appearance. What is also needed is a door handle fastener system that rigidly secures the door handle to the door, yet conceals the presence of fasteners from the face of the door. Finally, what is further needed is an improved door handle designed to accommodate the above-mentioned, improved fastener system.

SUMMARY AND OBJECTS OF THE INVENTION

A concealed fastener adapter for a door handle includes a top plate attached to the surface of the door. The top plate attaches to the surface of the door and acts as a base for the door handle. A bottom plate may also be used opposite the top plate to provide additional support for the door handle. The door handle further includes a receiving bore for receiving a fastener that engages with the top plate. A receiving slot may also be included in the door handle that engages with the bottom plate. A selective amount of friction may be applied to the fastener, further engaging the top plate, thereby displacing the door handle and generating a frictional interference with the bottom plate and the receiving slot, thus securing the door handle in place. The selective amount of friction is created by driving the fastener further into the receiving bore of the door handle, thus urging the door handle away from the top plate and increasing the frictional interference with the bottom plate.

The door handle includes a generally planar portion configured to lay flush on the surface of the door and a recessed portion configured to rest below the surface of the door in one of a hole or recess in the surface of the door. The receiving slot in the door handle is located on the rear of the door handle, facing the door, and is preferably in a portion of the door handle below the surface of the door within the one of a hole or recess.

The top plate includes a planar section that mounts flush on the surface of the door. A bulging portion extends from the planar section of the top plate and is configured to extend below the surface of the door when the top plate is installed. The bottom plate also includes a first planar section configured to mount flush with the surface of the door. The bottom plate differs from the top plate in that an angled section extends from the first planar section, and a second planar section extends from the angled section opposite the first planar section. The two planar sections on the bottom plate are parallel to one another, thus forming a substantially "z" shape.

According to another embodiment, the door handle fastening system may be installed on a door with one of a hole or recess. The hole or recess is provided in the door to accept the handle and allow it to mount flush or close to flush with the surface of the door. A first plate allows the handle to attach to the surface of the door such that a portion of the first plate overhangs the hole or recess in the door. A receiving bore in the door handle accepts a fastener configured to apply a user definable amount of friction against the plate, thereby displacing the door handle and generating a frictional interference between the first plate and the door handle. The receiving bore in the door handle is also in a connecting portion joining the planar portion and the recessed portion of the door handle, thereby hiding it from view when installed in the door.

A second plate with a first planar section is configured to mount flush with the surface of the door opposite the first plate. As previously mentioned, an angled section extends from the first planar section of the second plate, and a second planar section is parallel to the first planar section of the second plate, thus forming a substantially "z" shape. A receiving slot in the door handle receives the second planar section of the second plate to secure the plate in place. The second planar section of the second plate extends below the surface of the door within the hole or recess in the door. A frictional interference is generated between the receiving slot of the door handle and the second planar section of the second plate. As the frictional interference is increased by further engaging the fastener against the first plate, the second planar section of the second plate is further pressed into the receiving slot.

The door handle fastening system also includes a planar portion of the door handle configured to rest flush on the surface of the door surrounding the hole or recess in the door. The door handle also has a recessed portion, offset from the planar portion, configured to rest beneath the surface of the door within the hole or recess in the door.

Also described herein is a method of fastening a door handle to a door using the above-mentioned apparatus. The door handle may be fastened to the door by forming either a hole or recess in the door for receiving the door handle. The hole or recess allows for a locking mechanism to be inserted within a mortised slot in the door that is operated by the door handle. A first plate with a planar portion on a first end and either an angled or a curved portion on the second end of the first plate is used to mount the door handle to the door. The planar portion of the first plate is secured flush to a surface of the door such that the angled or curved portion of the first plate overhangs the hole or recess in the door.

The door handle is mounted over the hole or recess in the door, thus concealing the hole or recess. To fasten the door handle to the door, a fastener is inserted into a recessed portion of the door handle such that the fastener is at least partially concealed by the door handle. The fastener may then be adjusted so that the fastener intersects the angled or curved portion of the first plate in an interference fit. This interference fit thus urges the door handle away from the first plate and secures the door handle over the hole or recess in the door.

A second plate may also be used opposite the first plate. A first planar section of the first plate is configured to mount flush with the surface of the door opposite the first plate, and includes an angled section extending from the first planar section of the second plate and a second planar section parallel to the first planar section of the second plate, thus forming a substantially "z" shape.

The second planar section of the second plate is inserted into a receiving slot in the door handle such that the fastener is adjusted to intersect the angled or curved portion of the first plate, thus urging the second planar section of the second plate further into the receiving slot. The fastener may be adjusted such that it recedes into the recessed portion of the door handle in a countersunk fashion to conceal it and further secure the door handle to the door. Both the first plate, second plate, and the hole or recess in the door are therefore concealed by the door handle.

A second fastener may also be used in the recessed portion of the door handle such that the second fastener is at least partially concealed by the door handle. The second fastener may be adjusted to also intersect the angled or curved portion of the first plate also producing an interference fit, thus urging the door handle away from the first plate and securing the door handle over the hole or recess in the door.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which:

FIG. 6 is a front view of the door handle of FIG. 2 in an uninstalled position;

FIG. 7 is a back view of the door handle of FIG. 2 in an uninstalled position;

FIG. 8 is a bottom view of the door handle of FIG. 2 in an uninstalled position;

FIG. 9 is a sectional view of the door handle of FIG. 6 along section line BB;

FIG. 10 is a sectional view of the door handle of FIG. 6 along section line CC;

FIG. 11 is a detail view of the door handle of FIG. 10 within detail line A;

FIG. 12 is a detail view of the door handle of FIG. 10 within detail line D;

FIG. 18 is a front view of the bottom plate adapter of FIG. 17;

FIG. 19 is a side view of the bottom plate adapter of FIG. 17; and

FIG. 20 is a sectional view of the bottom plate adapter of FIG. 18 along section line EE.

Figure 1:
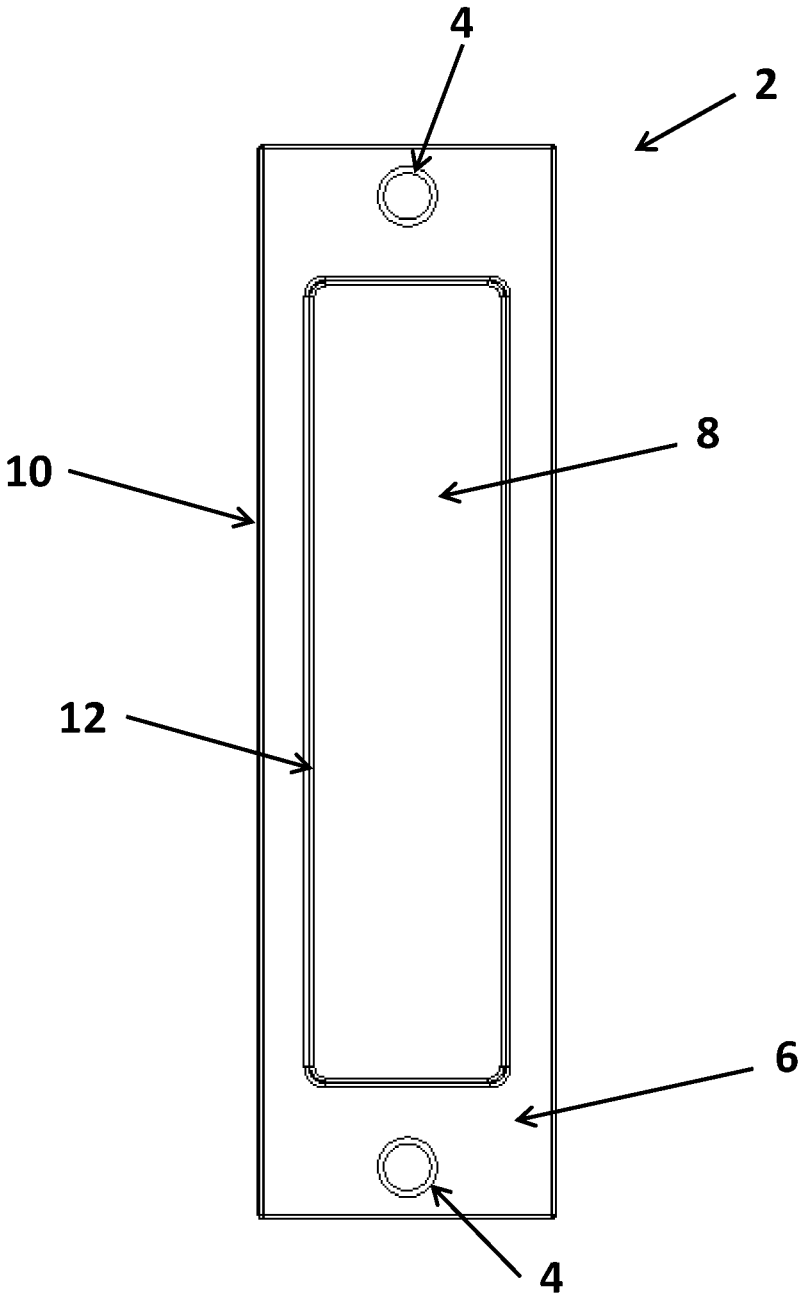
FIG. 1 PRIOR ART
FIG. 1 is a front view of a door handle with visible fasteners as known by the prior art.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Corresponding reference characters in the drawings indicate corresponding parts throughout the several views. The exemplification set out herein illustrates embodiments of the invention, and such exemplification is not to be construed as limiting the scope of the invention in any manner.

DETAILED DESCRIPTION

The figures and descriptions provided herein may have been simplified to illustrate aspects that are relevant for a clear understanding of the devices, systems, and methods described herein, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well-known in the art and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

FIG. 1 shows a door handle 2 according to the prior art. The door handle 2 uses a pair of faster holes 4 that receive any fastener such as a nail or a screw to secure the door handle 2 to a door (not shown). The door handle 2 is typically installed such that the edge 10 of the door handle 2 is proximate to the vertical edge of the door. The exact location of the fastener hole 4 can vary in the prior art, but the fastener hole 4 is commonly on a front surface 6 of the door handle 2. By locating the fastener hole 2 on the front surface 6 of the door handle 2 it is easy to fasten the door handle 2 to a door. The fastener also provides a secure attachment of the door handle 2 to the door as there is increased strength provided by attaching the fastener perpendicular to the width of the door.

In operation of the door handle 2, a user typically uses an indentation 8 in the door handle 2 to provide a pulling edge 12, allowing the user's fingers to grasp the door handle 2 and slide the door. Different style door handles are also used, which include levers and knobs, but a sliding door handle that mounts flush to a surface of the door is the preferred application for the invention.

Figure 2:
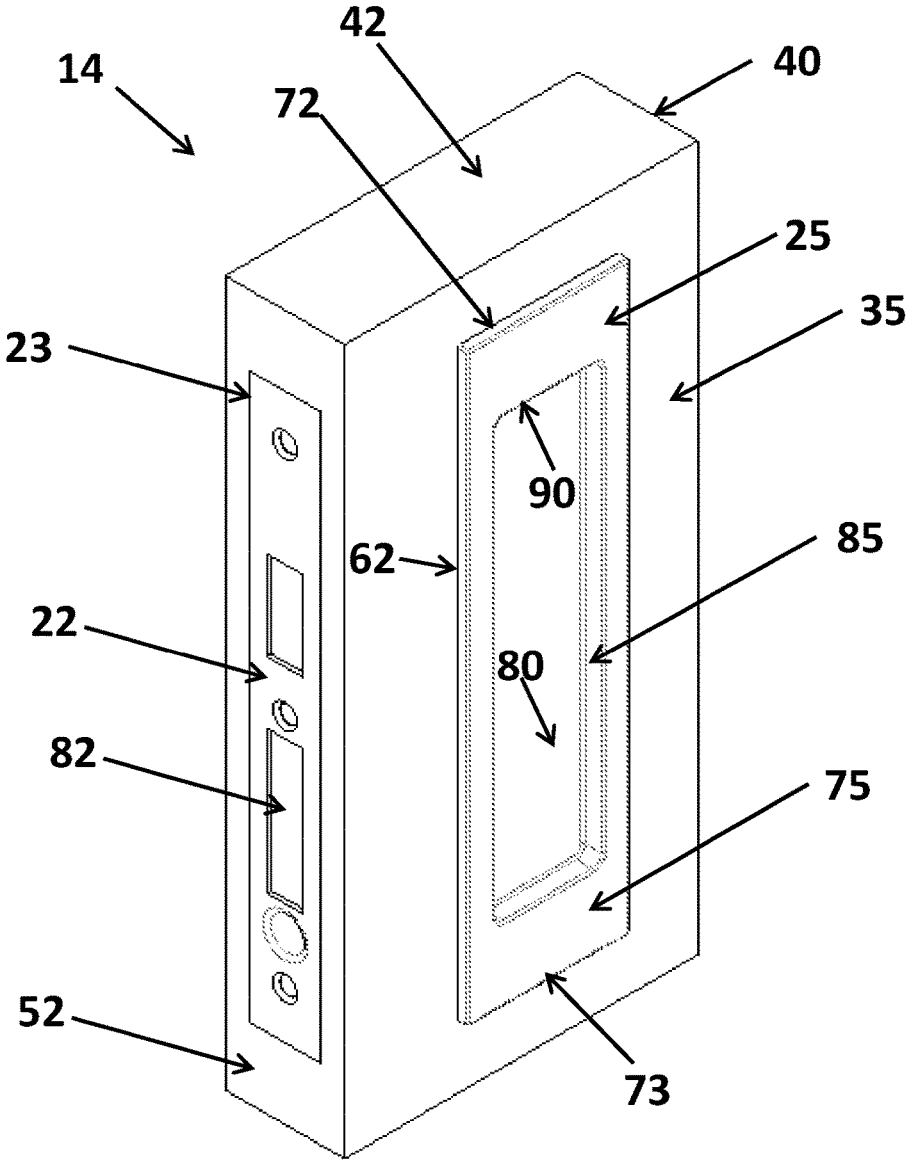
FIG. 2 is a front perspective view of a door handle attached to a door using the inventive adapter with hidden fasteners according to a preferred embodiment of the invention.

FIG. 2 shows a preferred embodiment of the inventive door handle 25 mounted on a door 40. In this embodiment, the door with the inventive handle 14 is for a sliding door, such as a pocket door. The door 40 is merely a representation of a typical slab door and is not proportional in size to the door handle 25.

The exemplary door handle 25 is formed in a rectangular fashion with a side edge 62, top edge 72, and bottom edge 73. The door handle 25 need not be limited to a rectangular design as depicted. Any other shape may be used for the door handle as long as it includes a planar portion 75, a recessed portion 80, a connecting portion 85 joining the recessed portion 80 to the planar portion 75, and a hidden portion 90. The hidden portion is essentially the connecting portion 85 along the top edge 72 of the door handle 25. When the door handle 25 is installed in the door 40, the connecting portion 85 along the top edge 72 of the door handle 25 may not be seen by a typical person in a standing position. The hidden portion 90 is, therefore, concealed from normal sight as door handles are typically mounted below the top 42 of the door 40 at about the midpoint of the door 40 along the lock stile 52 of a panel door. The door handle 25 may also be mounted at the midpoint along the edge of a slab door. Wherever the door handle 25 is mounted, it is well below the top 42 of the door 40 placing the hidden portion 90 of the door handle 25 hidden from view by a typical person in an upright position.

The door handle 25, as shown in the preferred embodiment is configured for installation in a mortised pocket 23. The mortised pocket 23 accepts the mortise lock 22 that includes a lock latch 82 to lock the door closed when in a closed position. While a mortise-style lock 22 is shown, the door handle 25 may be used without a lock or with a different type of lock. The planar portion 75 of the door handle 25 rests flush on the surface 35 of the door 40. The recessed portion 80 is recessed into the door in a cut-out hole or recess. The cut-out from the door 40 allows the mortise lock 22 to attach to the door handle 25 and allows the door handle 25 to be fastened to the door 40 through the hidden portion 90.

Figure 3:
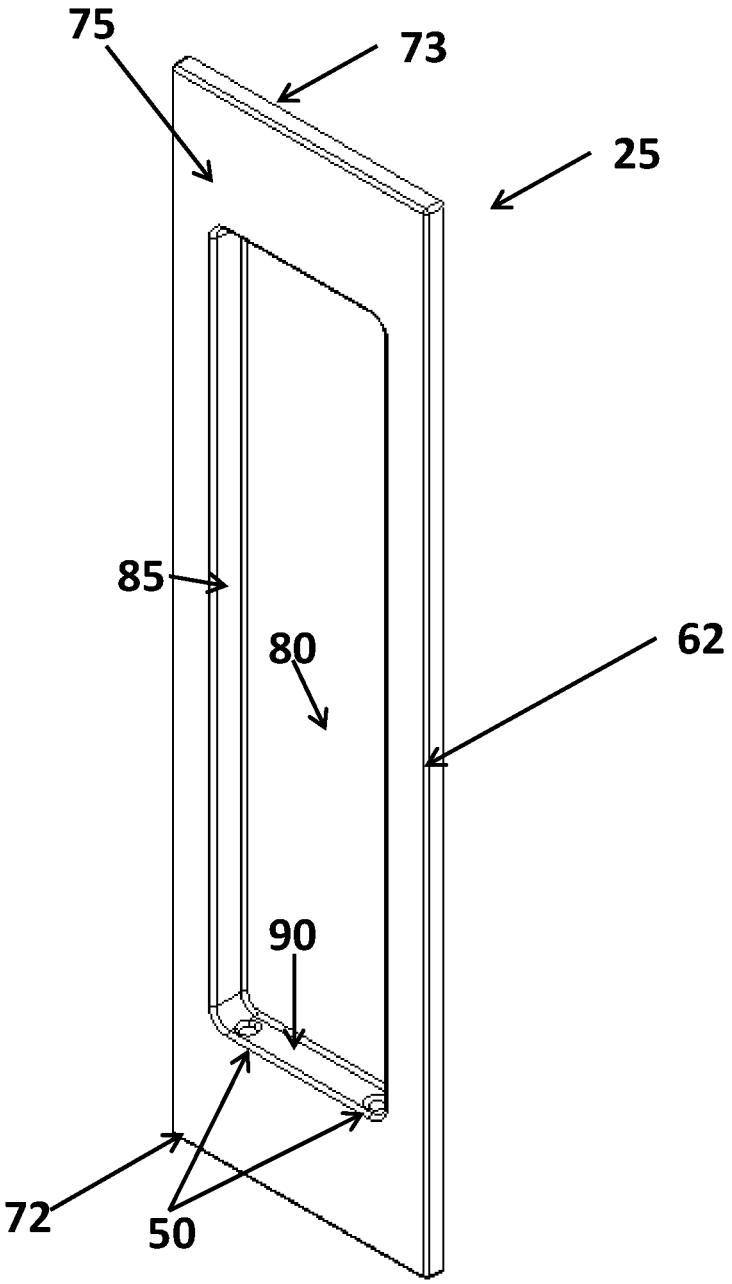
FIG. 3 is a front perspective view of the door handle of FIG. 2 in an inverted position showing receiving bores for fasteners in their hidden location.

The hidden portion 90 is revealed in FIG. 3 as the door handle 25 is in an inverted position. While the door handle 25 is depicted as rectangular with a side edge 62, top edge 72, and bottom edge 73, the door handle 25 may be square, round, or any other geometric shape. Preferable, the shape of the door handle 25 allows for a hidden portion 90 that is on the top edge 72 side of the door handle 25, which helps conceal any receiving bores 50. The receiving bores 50 are in the hidden portion 90 of the connecting portion 85. The receiving bores 50 are threaded to accept fasteners such as set screws that can be countersunk into the door handle 25 to further conceal the fastener. While a pair of receiving bores 50 is shown, there may be more or less. The receiving bores 50 are also preferably only in the top edge 72 portion of the door handle 25, and an alternative fastening method is used for the bottom edge 73 portion of the door handle 25 that does not include receiving bores 50 as shown in FIG. 5, for example.

Figure 4:
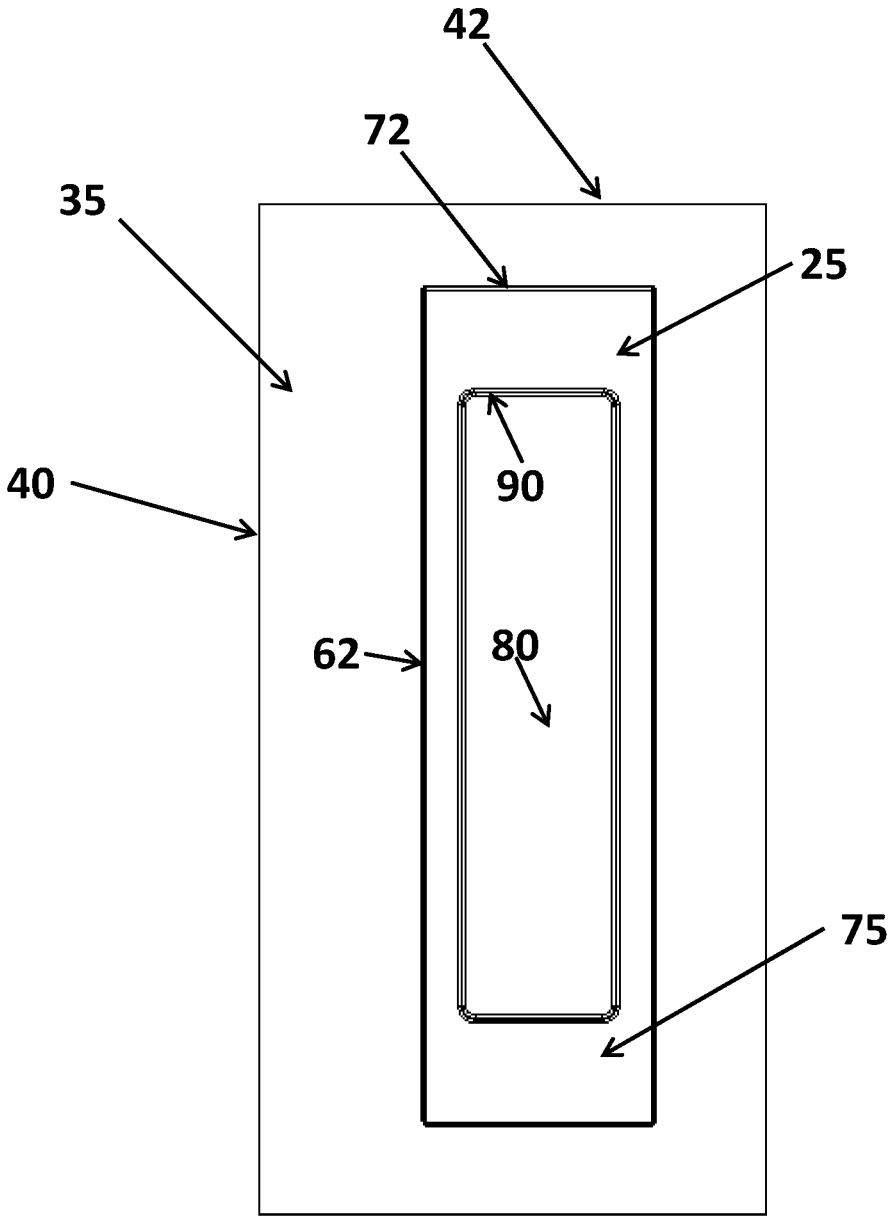
FIG. 4 is a front view of the installed door handle of FIG. 2.

Looking at FIG. 4, the door handle 25 is shown installed on a door 40 as shown in FIG. 2. As can be seen, even when eye-level of a user is at the height of the door handle 25 on the door 40, the hidden portion 90 remains concealed such that the receiving bores 50 (see FIG. 3) are not visible.

Figure 5:
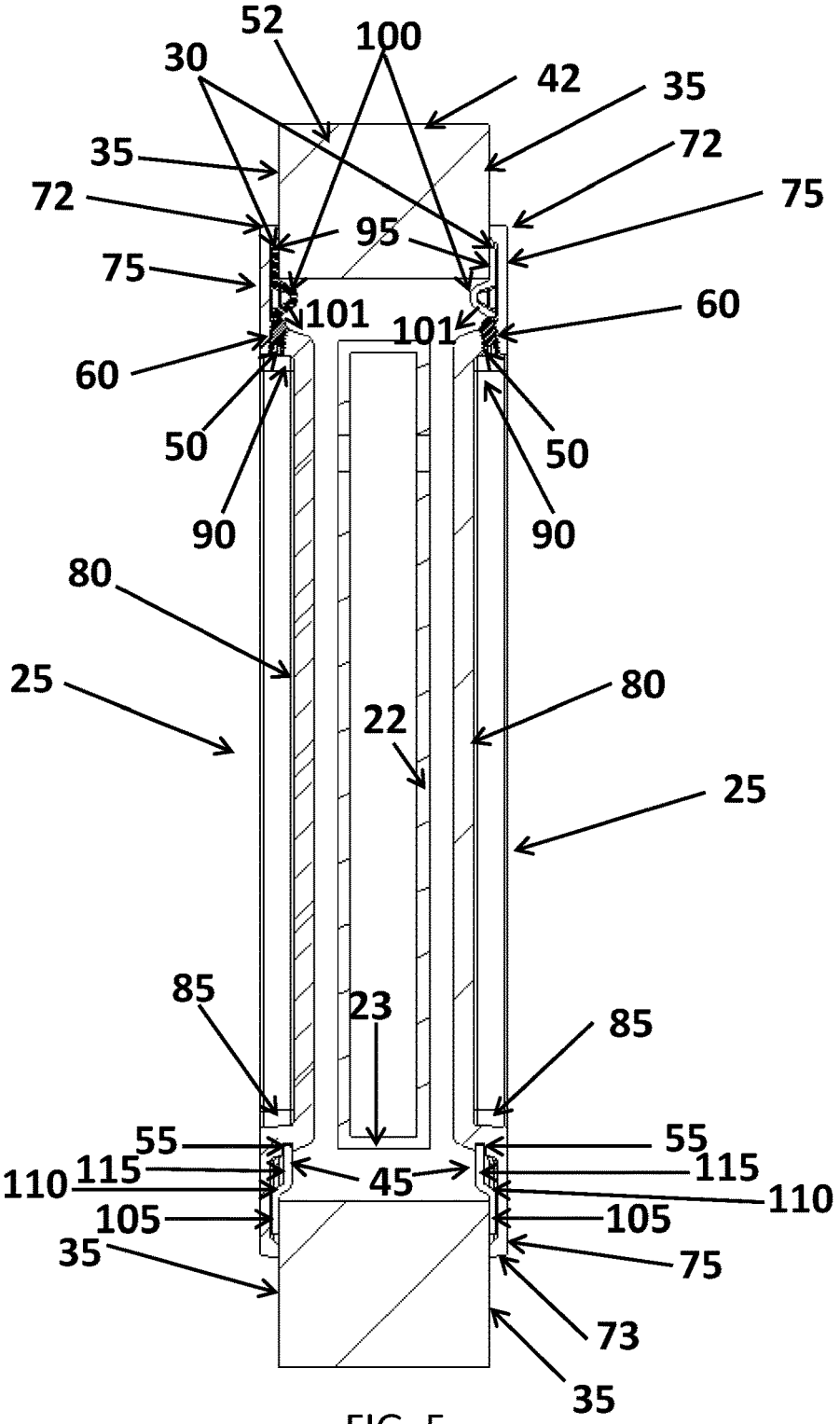
FIG. 5 is a sectional view of the door handle as shown in FIG. 4 along section line AA.
Figure 13:
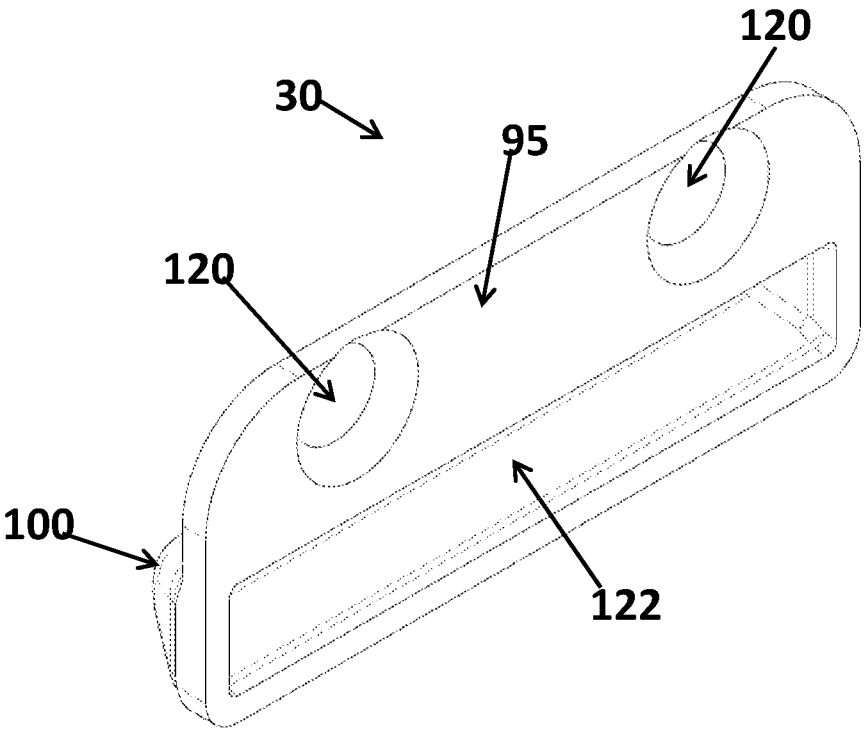
FIG. 13 is a raised perspective view of a top plate adapter used to mount the door handle of FIG. 2 with hidden fasteners to a door.
Figure 14:
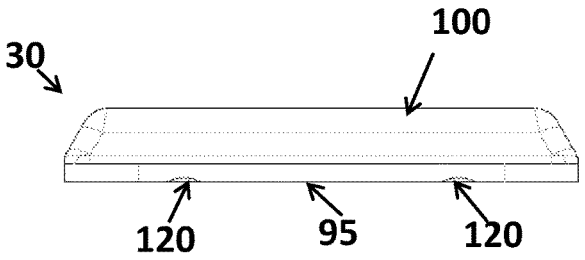
FIG. 14 is a bottom view of the top plate adapter of FIG. 13.
Figure 16:
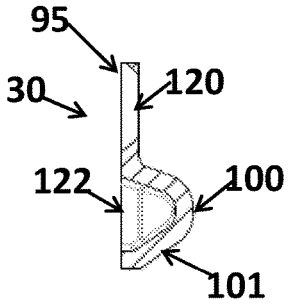
FIG. 16 is a sectional view of the top plate adapter of FIG. 15 along section line DD.
Figure 15:
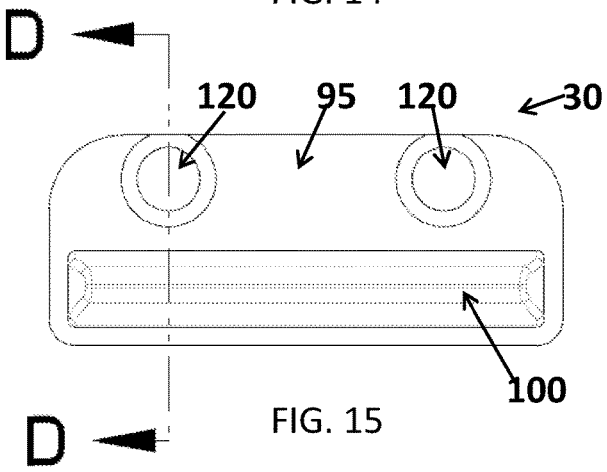
FIG. 15 is a front view of the top plate adapter of FIG. 13.

Transitioning now to FIG. 5, a cross sectional view of a pair of door handles 25 installed in a door 40, as done in a typical installation of the invention, is shown. Each receiving bore 50 accepts a fastener 60 in the form of a set screw. While a set screw is the preferred fastener 60, any other fastener 60 may also be used. Preferably the fastener 60 is able to be countersunk into the receiving bore 50 of the hidden portion 90 of the recessed portion 80 to allow concealment. The fastener 60 contacts a bulging portion 100 of a top plate 30. The top plate 30 may be fastened to the surface 35 of the door 40. Once the top plate 30 is secured to the surface 35 of the door 40, a bulging portion 100 of the top plate 30 projects into the mortise pocket 23 that is cut out of the door 40. The bulging portion 100 is therefore set within the door 40 below the surface 35. The door handle 25 is then placed over the top plate 30 to conceal the top plate 30. The receiving bore 50 in the hidden portion 90 of the door handle 25 is angled such that the fastener 60 contacts the bulging portion 100 of the top plate 30. As the fastener 60 is tightened into the receiving bore 50, the fastener 60 contacts the bulging portion 100, which pushes the door handle 25 away from the top plate 30.

Figure 17:
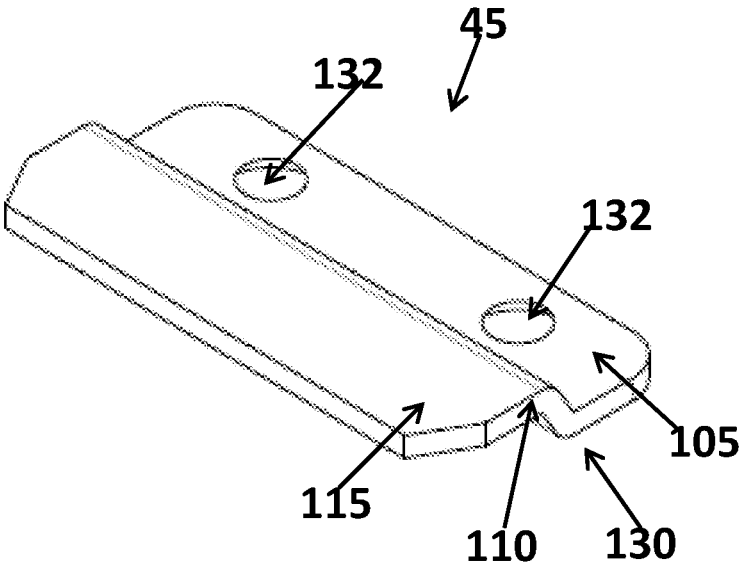
FIG. 17 is a raised perspective view of a bottom plate adapter used to mount the door handle of FIG. 2 with hidden fasteners to a door.

At the opposite side of the door handle 25, or the bottom edge 73, a bottom plate 45 is secured to the surface 35 of the door 40. The bottom plate 45 is shaped uniquely from the top plate 30. The bottom plate 45 has a substantially "z" shape when viewed from the side, as best seen in FIGS. 17 and 19. The bottom plate 45 includes a first planar section 105 that is secured to the surface 35 of the door 40. An angled section 110 projects the second planar section 115 of the bottom plate 45 into the mortise pocket 23 cut into the door 40. The first planar section 105 and the second planar section 115 are parallel to one another. As a result, the second planar section 115 of the bottom plate 45 is parallel to the surface 35 of the door 40.

The door handle includes a receiving slot 55 proximate the bottom edge 73. The receiving slot 55 is configured to receive the second planar section 115 of the bottom plate 45. As the fastener 60 is tightened, it pushes the door handle 25 away from the bulging portion 100 of the top plate 30. Due to the angle on the bulging portion 100 and the angle of the tip of the fastener 60, the receiving slot 55 is urged linearly into the second planar section 115 of the bottom plate 45. The opposing forces generated by the top plate 30 and the bottom plate 45 against the door handle 25 work to lock the door handle 25 into place and effectively secure it to the door 40.

The angle of the bulging portion 100 on the top plate 30 and the receiving slot 55 in the door handle 25 for the bottom plate 45 prevent the door handle 25 from "popping out" of the mortise pocket 23. The bulging portion 100 on the top plate 30 creates a force 101 towards the bottom plate and into the mortise pocket 23 as well to secure the top edge 72 of the door handle 25 in place. The receiving slot 55 surrounds the second planar section 115 preventing the bottom edge of the door handle 25 from moving in any direction, except towards the top plate 30. As a result, the fastener 60 may be selectively tightened to center the door handle 25 into the optimal position to be located over the mortise pocket 23 and engage with the mortise lock 22 for proper functionality.

It has been contemplated to secure the door handle 25 to the door 40 by simply inserting screws into the receiving bores 50 that penetrate into the door 40. Additional receiving bores 50 may also then be provided opposite the top edge 72 in the connecting portion 85 by the bottom edge 73. Such a design would eliminate the need for a top plate 30 or a bottom plate 45. Research has shown such a proposed design to be problematic in that the door handle 25 has to be kept in position as the fasteners are secured into the door 40. As the fasteners on the top side are tightened, the door handle 25 is urged downward. Similarly, as the bottom screws are tightened, the handle is urged upwards. As a result, it would be necessary to tighten each screw a little at a time. It also proved to be difficult to align the door handle 25 properly to interact with the mortise lock 22. The top plate 30 and bottom plate 45 interaction with the fastener 60 and receiving slot 55, respectively, eliminate the need to tighten opposing fasteners a little at a time, all while holding the door handle 25 steadily in position.

A single door handle 25 may be secured to the door 40 on a single side of the door 40, or a door handle 25 may be secured on the opposing side of the door 40, directly opposite of the first door handle 25, as is shown in FIG. 5. Should a single handle be desired, such as for a hall closet, the mortise pocket 23 need note extend through the door 40. If a lock is not desired, the mortise lock 22 may also be eliminated. Such an application would eliminate the need for a mortise pocket 23 and require only a recess cutout into the surface 35 of the door 40 deep enough to allow the recessed portion 80 of the door handle 25 to sit within the door 40. A lock-less installation would also require ample room in the recess cut into the door 40 to allow the bulging portion 100 and second planar section 115 of the top plate 30 and bottom plate 45 to rest below the surface 35 of the door 40, respectively.

Looking now at FIGS. 6-12, various views of the door handle 25 are shown. FIGS. 6 and 7 show the front and back sides of the door handle 25, respectively. The recessed portion 80 can best be seen in FIG. 7. The connecting portion 85 has a slight taper on all sides of the recessed portion 80 which provides a slight angle. As a result of that slight angle, the receiving bores 50 project the fasteners 60 at a slight angle, as best seen in FIG. 5. The angle of the connecting portion 85 may be adjusted or not present. For example, the connecting portion 85 may extend from the planar portion 75 at a right angle or any other angle. The bulging portion 100 on the top plate 30 may be adjusted to compensate for any changes to the angle of the connecting portion 85 to achieve the desired retaining forces generated by tightening the fastener 60 as shown in FIG. 5.

FIG. 8 shows the door handle 25 as seen from the bottom edge 73. The receiving slot 55 can clearly be seen in this view. As previously discussed with respect to FIG. 5, the receiving slot 55 accepts the second planar section 115 of the bottom plate 45. Once the second planar section 115 has nested within the receiving slot, it secures the door handle 25 and in place preventing it from being pried off or separating from the surface 35 of the door 40.

FIG. 9 shows a section view along section line BB as seen in FIG. 6. The hidden portion 90 can be seen as well as the receiving bores 50. Also visible is the connecting portion 85 that extends from the planar portion 75. The overall profile of the door handle 25 is a flat and planar surface 75 that is exposed to the operator of the door handle 25. The planar surface 75 also extends from the surface 35 of the door 40 by the width of the side edge 62. The base 81 of the door handle 25 extends into the door 40 and rests within the mortise pocket 23 as seen in FIG. 5.

FIG. 10 shows another sectional view of the door handle along section line CC as seen in FIG. 6. The planar portion 75 extends around the top edge 72 and the bottom edge 73 of the door handle 25. The recessed portion 80 is countersunk into the door handle 25 below the plane of the planar surface 75. The connecting portion 85 joins the planar portion 75 to the recessed portion 80.

Looking to detail A in FIG. 11, a close-up view within detail line A is shown. The receiving bore 50 can be seen to include a slight angle with respect to the recessed portion 80. As previously mentioned, this angle allowed the fastener 60 to provide a force into the door 40 that retains the door handle 25 in place. This retaining force 101 is generated as a result of the angle of the fastener 60 and the bulging portion 100 of the top plate 30. The resulting force 101 from tightening the fastener 60 results in an opposing force 101 away from the bulging portion 100 in a direction normal to the surface of the bulging portion 100. See for example FIG. 5 for a representation of the force 101.

Detail D in FIG. 12 also shows a detail view within detail line D as seen in FIG. 10. Detail D shows the receiving slot 55 which is formed in the connecting portion 85. The receiving slot preferably forms a pocket that the second planar section 115 of the bottom plate 30 slides into. The receiving slot 55 may be formed in any shape and is not limited to the shape depicted in FIG. 12. The receiving slot 55 should be formed in any shape so as to accept the second planar section 115 of the bottom plate 30.

Looking now at FIGS. 13-16, various views of the top plate 30 are shown. The top plate 30 includes a bulging portion 100, which is created by forming the planar portion 95 with a recess creating the interior 122 of the bulging portion 100. This interior 122 is shown as hollow which lends itself to simple manufacturing processes such as stamping. The top plate 30 may be constructed with other manufacturing processes such as casting, forging, or machining, which may produce a solid top plate 30 without a hollow interior 122. A pair of fastener holes 120 is provided on the planar portion 95, which allow the top plate 30 to be fastened to the surface 35 of a door 40 as best shown in FIG. 5. As previously mentioned, the exact geometry of the bulging portion 100 may be modified. The purpose is to provide an angled contact to create a retaining force 101 when a fastener is pressed against the bulging portion 100, as best depicted in FIG. 5.

FIGS. 17-20 similarly show the bottom plate 45. The first planar section 105 includes fastener holes 132 and allows the bottom plate 45 to be secured to the surface 35 of a door 40, as best shown in FIG. 5. Just as with the top plate 30, the first planar section 105 is designed to rest flush on the surface 35 of the door 40 and provide a low-profile mount for the planar portion 75 of the door handle 25 to cover. The angled section 110 projects the second planar section 115 below the surface 35 of the door 40. As best seen in FIG. 19, the second planar section 115 is parallel to the first planar section 105. FIG. 20 also shows the fastener holes 136 as chamfered, which allows a fastener head to be flush with the first planar section 105. The fastener holes for both the top plate 30 and the bottom plate 45 are preferably chamfered to allow fasteners to remain flush, providing a lower profile which makes it easier to mount the door handle 25 to the surface 35 of the door 40 without obstruction.

While the preferred embodiment includes a top plate 30 and a bottom plate 45, it is envisioned that a single plate may be used to secure the door handle 25 to the door 40. In such a configuration the single plate may be fastened behind the recessed portion 80 of the door handle 25. Fasteners may be used to secure the door handle 25 to the single plate. An additional plate may then be inserted into the recessed portion 80 to conceal the single plate.

The top plate 30 and bottom plate 45 may also be joined together as a single plate to make it easier to locate the proper spacing necessary to affix each respective plate to the door 40. The connecting piece joining each plate may then be concealed by the handle 25 or broken off from each plate.

The location of the top plate 30 and bottom plate 45 may also be reversed and the receiving bores 50 and receiving slot also reversed on the door handle 25. The receiving bores may also be concealed with plugs that are inserted into the receiving bores 50.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

We claim:

1. A concealed fastener adapter for a door handle comprising:

a top plate configured for attachment to a surface of a door;

a bottom plate configured for attachment to the surface of the door opposite the top plate;

a door handle a receiving bore in the door handle;

a receiving slot in the door handle configured to receive the bottom plate; and a fastener engaging the receiving bore in the door handle and configured to apply a selective amount of friction against the top plate, thereby displacing the door handle and generating a frictional interference with the bottom plate, thus securing the door handle in place.

2. The concealed fastener adapter according to claim 1, wherein the door handle includes a generally planar portion configured to lay flush on the surface of the door, and a recessed portion configured to rest below the surface of the door in one of a hole or recess in the surface of the door, and, wherein, the receiving slot of the door handle is located in a portion of the door handle below the surface of the door.

3. The concealed fastener adapter according to claim 1, wherein the top plate includes a planar section configured to mount flush on the surface of the door and a bulging portion configured to extend below the surface of the door.

4. The concealed fastener adapter according to claim 3, wherein the bottom plate includes a first planar section configured to mount flush with the surface of the door, and an angled section extending from the first planar section, and a second planar section parallel to the first planar section, thus forming a substantially "z" shape.

5. The concealed fastener adapter according to claim 4, wherein the selective amount of friction is created by driving the fastener further into the receiving bore of the door handle, thus urging the door handle away from the top plate and increasing the frictional interference with the bottom plate.

6. A method of fastening a door handle to a door comprising the steps:

forming at least one of a hole or recess into the door for receiving the door handle;

providing a first plate with a planar portion on a first end and at least one of an angled and a curved portion on a second end;

securing the planar portion of the first plate to a surface of the door such that at least one of the angled and curved portion overhangs at least one of the hole or recess in the door;

placing the door handle over at least one of the hole or recess in the door;

inserting a fastener into a recessed portion of the door handle such that the fastener is at least partially concealed by the door handle; and adjusting the fastener to intersect at least one of the angled and curved portion of the first plate such that an interference fit is generated, thus urging the door handle away from the first plate and securing the door handle over the hole or recess in the door.

7. The method of fastening a door handle to a door according to claim 6, further comprising the steps:

providing a second plate with a first planar section configured to mount flush with the surface of the door opposite the first plate, wherein the second plate further includes an angled section extending from the first planar section of the second plate and a second planar section that is one of parallel and not parallel to the first planar section of the second plate, thus forming a substantially "z" shape; and inserting the second planar section of the second plate into a receiving slot in the door handle such that the fastener is adjusted to intersect at least one of the angled and curved portion of the first plate, thus urging the second planar section of the second plate further into the receiving slot.

8. The method of fastening a door handle to a door according to claim 7, further comprising the step of continuing to adjust the fastener such that it recedes into the recessed portion of the door handle in a countersunk fashion.

9. The method of fastening a door handle to a door according to claim 6, further comprising the step of concealing the first plate and the one of a hole or recess in the door with the door handle.

10. The method of fastening a door handle to a door according to claim 6, further comprising the step of:

inserting a second fastener into the recessed portion of the door handle such that the fastener is at least partially concealed by the door handle; and adjusting the second fastener to intersect at least one of the angled and curved portion of the first plate such that an interference fit is generated, thus urging the door handle away from the first plate and securing the door handle over the hole or recess in the door.

11. A door handle adapter comprising:

a first plate configured for attachment to a surface of a door, wherein the first plate includes a planar section configured to mount flush on the surface of the door and a bulging portion configured to extend below the surface of the door;

a second plate configured for attachment to a surface of a door opposite the first plate, wherein the second plate includes a first planar section configured to mount flush with the surface of the door and an angled section extending from the first planar section and a second planar section parallel to the first planar section, thus forming a substantially "z" shape;

a receiving bore in the door handle;

a receiving slot in the door handle configured to receive the bottom plate; and a fastener engaging the receiving bore in the door handle and configured to apply a selective amount of friction against the first plate, thereby displacing the door handle and generating a frictional interference with the second plate, thus securing the door handle in place.

12. The door handle adapter according to claim 11, further comprising:

a second receiving bore in the door handle proximate the first receiving bore;

a second fastener engaging the second receiving bore in the door handle and configured to apply a selective amount of friction against the first plate, thereby displacing the door handle and generating a frictional interference with the second plate, thus securing the door handle in place; and wherein the first and second bore are located between a planar surface of the door handle configured to rest on the surface of the door.

13. The door handle adapter according to claim 11, further comprising:

a recessed portion on the door handle, offset from the planar portion, configured to rest beneath the surface of the door within one of a hole or recess in the door; and a planar portion on the door handle configured to rest flush on the surface of the door surrounding the one of a hole or recess in the door;

wherein the receiving bore in the door handle is in a connecting portion joining the planar portion and the recessed portion of the door handle.

14. The door handle adapter according to claim 11, wherein the fastener is countersunk in the receiving bore, thus obscuring the fastener from view.

15. The door handle adapter according to claim 11, wherein the door handle covers and obscures from view the first and second plates.

* * * * *